United States Patent [19]

Fang

[11] Patent Number: 4,745,518

[45] Date of Patent: May 17, 1988

[54] MONITOR FILTER WITH STATIC ELIMINATING MEANS

[76] Inventor: Kuo C. Fang, No. 28, Lane 58, Kwang Fu S. Rd., Taipei, Taiwan

[21] Appl. No.: 32,537

[22] Filed: Apr. 1, 1987

[51] Int. Cl.[4] ..... H05F 1/00

[52] U.S. Cl. ..... 361/220; 358/252

[58] Field of Search ..... 361/212, 220; 358/252, 358/253, 255, 245; 350/276 R; 174/35 R, 35 MS File

[56] References Cited

U.S. PATENT DOCUMENTS

| | | | |
|---|---|---|---|
| 4,253,737 | 3/1981 | Thomsen et al. | 358/252 X |
| 4,468,702 | 8/1984 | Jandrell | 174/35 R X |
| 4,605,984 | 8/1986 | Fiedler | 361/220 |
| 4,661,856 | 4/1987 | Schnack | 358/252 |

FOREIGN PATENT DOCUMENTS

| | | | |
|---|---|---|---|
| 2067380 | 7/1981 | United Kingdom | 358/252 |

*Primary Examiner*—L. T. Hix
*Assistant Examiner*—Brian W. Brown
*Attorney, Agent, or Firm*—Sherman and Shalloway

[57] ABSTRACT

This invention relates to a monitor filter with a static eliminating means and in particular to one including a conducting net weaved by a plurality of nylon threads covered with black material, a plastic frame having two portions between which the circumference of the conducting net is fixedly attached, a static eliminating means mounted into the plastic frame, and a grounded plug connected with the static eliminating means and having a contact plate, whereby the induced static in the computer and the operator would be respectively transferred to the ground via the grounded plug and the contact plate.

1 Claim, 3 Drawing Sheets

MONITOR FILTER WITH STATIC ELIMINATING MEANS

BACKGROUND OF THE INVENTION

It has been found that glare, reflection and static induction will be produced when a monitor is in use. Hence, the glare and the reflection will damage the eyesight while the static induction will hurt both the eyesight and the face skin of the operator.

Accordingly, a filter net weaved by a plurality nylon fiber threads has been developed to reduce the glare and the reflection. However, it cannot obviate the damage from the static induction.

It is, therefore, an object of the present invention to provide a monitor filter which may obviate and mitigate the above-mentioned drawbacks.

SUMMARY OF THE INVENTION

This invention relates to an improved monitor filter which is provided with a static eliminating means.

It is the primary object of the present invention to provide a monitor filter which can eliminate the static in the computer body and the operator.

It is still another object of the present invention to provide a monitor filter which can reduce the glare.

It is still another object of the present invention to provide a monitor filter which can reduce the reflection.

It is still another object of the present invention to provide a monitor filter which can show out whether static eliminating is in process or not.

It is still another object of the present invention to provide a monitor filter which is simple in construction.

It is a further object of the present invention to provide a monitor filter which is easy to assemble.

The novel features which are characteristics of the invention, together with further objects and advantages thereof will be better understood from the following description considered in connection with the accompanied drawings and in which a preferred embodiment of the invention is illustrated by way of example. It is to be expressly understood, however, that the drawings are for the purpose of illustration and description only and are not intended as a definition of the limits of the invention.

DETAILED DESCRIPTION OF THE PREFERRED EMBODIMENT

Figure 1:
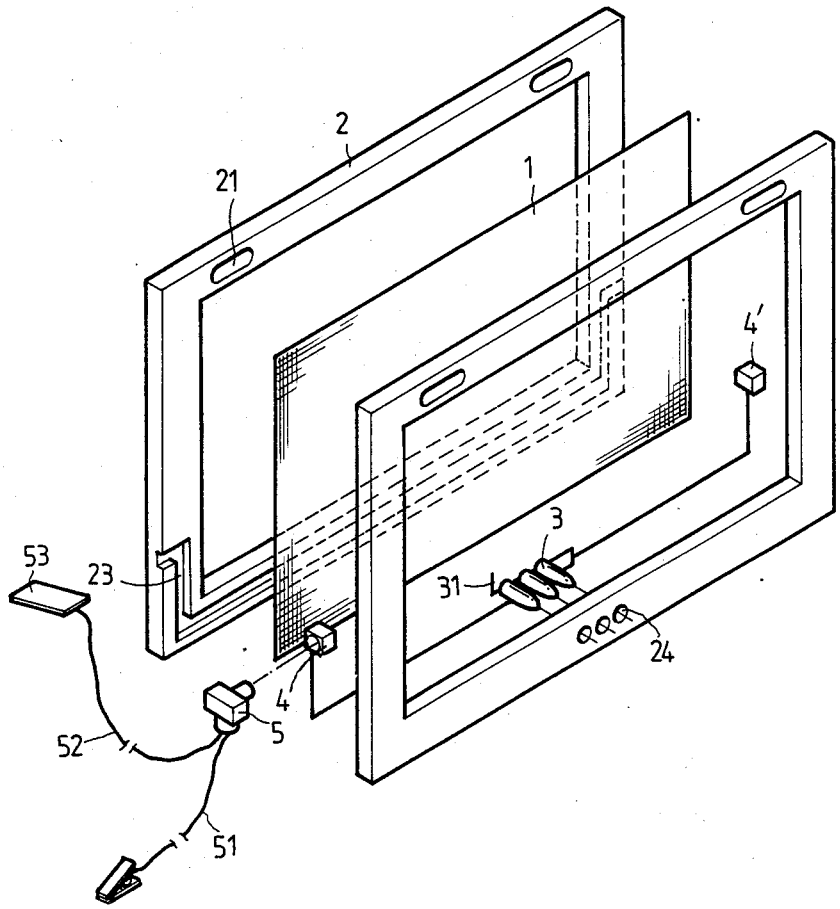
FIG. 1 is an exploded view of the present invention.

For purpose of promoting an understanding of the principles of the invention, reference will now be made to the embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

With reference to the drawings and in particular to FIG. 1 thereof, the monitor filter with a static eliminating means according to the present invention comprises a conducting net 1, a plastic frame 2 composed of two portions, and a static eliminating means. The conducting net 1 is weaved by a plurality of conducting nylon threads. The nylon threads are covered with black material so as to reduce the light reflection. The circumference of the conducting net 1 is clamped tight or otherwise fixedly attached between the two portions of the plastic frame 2. Each portion of the plastic frame 2 is provided with two slots 21 which, in association with two supspending cords 22, will enable the monitor filter to be hanged in front of a monitor 6.

Figure 2:
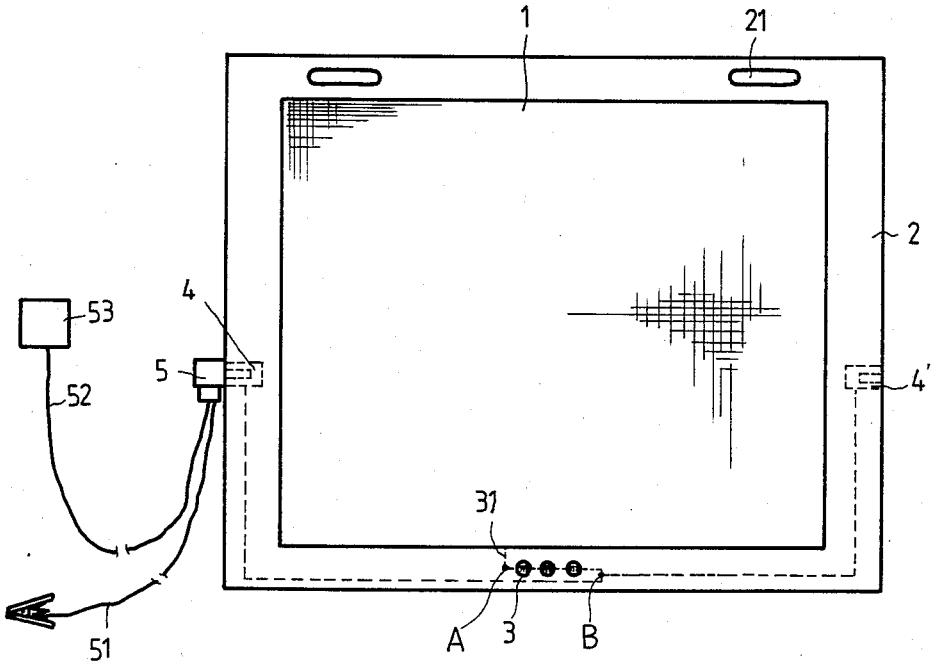
FIG. 2 is a front view of the present invention.
Figure 3:
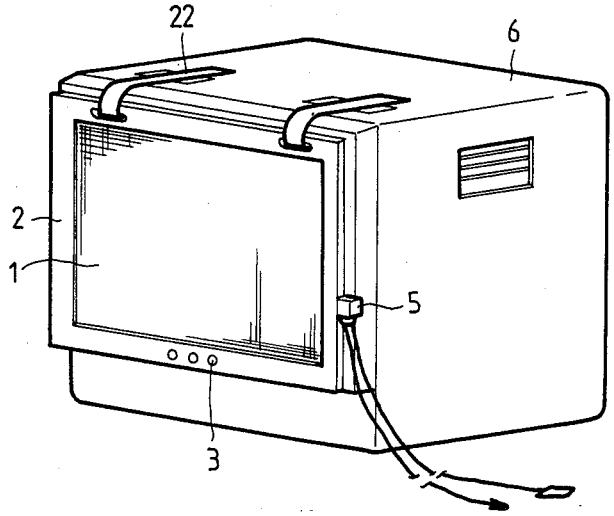
FIG. 3 shows an application of the present invention.

The static eliminating means is mounted in a slot 23 formed in the lower part of the plastic frame 2 (as shown in FIGS. 1 and 2). The static eliminating means comprises a set of light emitting diodes 3 connected in series. One end of the light emitting diodes 3 are connected in with a terminal 4 at the right side thereof and a terminal 4' at the left side thereof. Each of the terminal 4 and 4' is fixedly mounted at one side of the plastic frame 2 and can be connected with a grounded plug 5. One end (i.e., A) of the light emitting diodes 3 is connected to the net 1 via a wire 31 so as to conduct the induced static in the net 1 to the static eliminating means. In the lower part of the plastic frame 2 three holes are adapted to the light emitting diodes 3 so that it can be observed whether the light emitting diodes 3 give light or not.

The grounded plug 5 is provided with two wires 51 and 52. The end of the wire 51 is connected to the ground while the end of the other wire 52 is connected with a contact plate 53. The contact plate 53 is preferably made of conducting plastic for eliminating the static carried by the operator.

The functions of the present invention will be detailedly described hereinbelow:

1. Eliminating the induced static in the monitor

Referring to FIG. 2, the grounded plug 5 is first conveniently connected to either one of the sockets 4 and 4'. In the meantime, the static in the monitor body will be induced to the net 1 via the monitor 6, and then transmitted to the ground via the wire 31, the terminal A, the light emitting diodes 3, the terminal B, the socket 4 and the grounded wire 51.

2. Eliminating the static in the operator

As the operator gets in touch with the contact plate 53 with his hand, the static in the operator will be transmitted to the ground via the wire 52, the socket 4, the terminal A, the light emitting diodes 3 and the terminal B.

3. Indication of light emitting diodes

The light emitting diodes 3 will show whether the static elimination is in process or not. Further, they may give a reference to decide if static elimination has to be continued or not.

4. Simple in assembly

The grounded plug 5 may be conveniently connected to either one of the sockets 4 and 4' and the contact plate 53 of the grounded plug 5 may be extended to wherever it is convenient to be touched by the operator.

5. Eliminating glare and reflection

The glare and reflection will be reduced by the net.

Although this invention has been described with a certain degree of particularity, it is understood that the present disclosure is made by way of example only and that numerous changes in the construction and the combination and arrangement of parts may be resorted to without departing from the spirit and scope of the invention as hereinafter claimed.

I claim:

1. A monitor filter with a static eliminating means comprising:

a conducting net weaved by a plurality of nylon threads covered with black material;

a plastic frame having two portions between which the circumference of the conducting net is fixedly attached, each portion of the plastic frame being provided with two slots;

a static eliminating means mounted into the the plastic frames, said means comprising a set of light emitting diodes connected in series, one end of said series connected light emitting diodes is connected with a terminal disposed at one side of the plastic frame, the other end of said series connected light emitting diodes being connected to the conducting net via a wire;

a grounded plug having two wires respectively connected with ground and a contact plate, said grounded plug being engageable with the terminal mounted at one side of the plastic frame so that induced static in the conducting net and an operator would be respectively transferred to the ground via the grounded plug and the contact plate.

* * * * *